US007853179B2

(12) United States Patent
Nishi

(10) Patent No.: US 7,853,179 B2
(45) Date of Patent: Dec. 14, 2010

(54) METHOD AND APPARATUS FOR REGULATING TONER AMOUNT IN DEVELOPING CHAMBER OF IMAGE FORMING APPARATUS

(75) Inventor: Masayuki Nishi, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

(21) Appl. No.: 12/147,346

(22) Filed: Jun. 26, 2008

(65) Prior Publication Data

US 2009/0003851 A1 Jan. 1, 2009

(30) Foreign Application Priority Data

Jun. 27, 2007 (JP) ..... 2007-168769

(51) Int. Cl.
*G03G 15/01* (2006.01)

(52) U.S. Cl. ..... 399/227; 399/27; 399/43; 399/226; 399/258

(58) Field of Classification Search ..... 399/27, 399/43, 53, 61, 226, 227, 258
See application file for complete search history.

(56) References Cited

U.S. PATENT DOCUMENTS

| | | | | |
|---|---|---|---|---|
| 6,327,449 | B1 * | 12/2001 | Matsuzaki | 399/227 |
| 7,085,520 | B2 * | 8/2006 | Yamada et al. | 399/227 |
| 7,231,160 | B2 * | 6/2007 | Ichikawa et al. | 399/82 |
| 2005/0025513 | A1 | 2/2005 | Ichikawa et al. | |
| 2006/0098998 | A1 | 5/2006 | Yamada et al. | |

FOREIGN PATENT DOCUMENTS

| | | |
|---|---|---|
| JP | 5-27593 | 2/1993 |
| JP | 11-174775 | 7/1999 |
| JP | 2000-10401 | 1/2000 |
| JP | 2000-29299 | 1/2000 |
| JP | 2002-351188 | 12/2002 |
| JP | 2003-50494 | 2/2003 |
| JP | 2003-255685 | 9/2003 |
| JP | 2004-333725 | 11/2004 |
| JP | 2004-333726 | 11/2004 |
| JP | 2005-024945 | 1/2005 |
| JP | 2005-234010 | 9/2005 |
| JP | 2006-126554 | 5/2006 |

OTHER PUBLICATIONS

Japanese Office Action mailed on Oct. 27, 2009 directed at counterpart application No. 2007-168769;4 pages.

* cited by examiner

*Primary Examiner*—David M Gray
*Assistant Examiner*—Barnabas T Fekete
(74) *Attorney, Agent, or Firm*—Morrison & Foerster LLP

(57) ABSTRACT

In an image forming apparatus provided with a rotary type image developing apparatus, during monochrome print job processing, it is judged whether the amount of toner remaining in the developing chamber of the black developer unit is equal to or less than a predetermined amount M. If the judgement is affirmative, (i) the monochrome print job is suspended, (ii) the rotary rack is rotated to stop the black developer unit at the toner supply position temporarily, and is moved to the developing position again, and (iii) the monochrome print job is resumed. With the stated structure, the toner can be steadily supplied even when the amount of toner remaining in the developing chamber gets low during executing monochrome print jobs.

19 Claims, 9 Drawing Sheets

METHOD AND APPARATUS FOR REGULATING TONER AMOUNT IN DEVELOPING CHAMBER OF IMAGE FORMING APPARATUS

This application is based on application No. 2007-168769 filed in Japan, the content of which is hereby incorporated by references.

BACKGROUND OF THE INVENTION (1) Field of the Invention

The present invention relates to an image forming apparatus having a rotary developing apparatus which rotatably accommodates a plurality of developer units, and a control method of the image forming apparatus.

(2) Description of the Related Art

One type of image forming apparatus includes a rotary developing apparatus that accommodates developer units for respective toner colors of Cyan (C), Magenta (M), Yellow (Y), and Black (K) in a rotatable rack (hereinafter referred to as "rotary rack"), and that drives the rotary rack to rotate in order to bring a targeted one of the developer units to a developing position. The reduction in size and manufacturing cost has been demanded for image forming apparatuses provided with such rotary developing apparatuses. Accordingly, a simple and compact structure is demanded for the rotary developing apparatuses.

Usually, each developer unit has a toner storage and a developing chamber that receives toner from the toner storage and supplies the toner to a developing roller. However, for the purpose of the compact and simple structure mentioned as above, a toner supply mechanism such as a stirring blade used for delivering the toner from the toner storage to the developing chamber tend to be omitted.

The simplified rotary developing apparatus works as follows. When one of the developer units is located within a predetermined rotation range while the rotary rack being rotated, the toner in the toner storage naturally falls into the developing chamber through an opening of a partition part (partition wall) between the toner storage and the developing chamber. Thus, the toner is supplied from the toner storage to the developing chamber (For an example, see Japanese Laid-Open Patent Application No. 2006-126554).

When an image forming apparatus including such a rotary developing apparatus forms a full-color image, the rotary rack rotates by a predetermined angle (90 degrees) at a time to develop an image of a page in each color, thereby performing the multi-layer transfer. Accordingly, if each developing chamber contains at least the amount of toner sufficient to develop an image of one page, it is not necessary to provide a forced supply of toner during image formation. This is because the rotary rack always makes a 360° rotation before forming a color image of the next page, and during the 360° rotation, within a particular rotation range, the toner is supplied from the toner storage to the developing chamber by falling.

However, when numerous monochrome image forming jobs in black are executed consecutively, the rotary rack remains in the same position without rotating, and this may cause the developing chamber to become empty of the black toner. One way to avoid this is to suspend the execution of the monochrome image forming job, lead the toner to naturally fall into the developing chamber by rotating the rotary rack for 360° at a predetermined rotational speed, and subsequently resume the monochrome image forming job.

However, only a limited amount of toner falls into the developing chamber from the toner storage during a simple 360° rotation of the rotary rack. Besides, the amount of toner which falls into the developing chamber during a 360° rotation decreases with decrease of the amount of toner in the toner storage. As a result, stable toner supply to the developing chamber is impossible.

If the amount of toner supplied to the developing chamber is small, even if the monochrome image forming job is resumed, the developing chamber soon reaches the toner-empty state which requires the job to be suspended again and the rotary rack to make another 360° roll. This results in a lower efficiency in processing monochrome image forming jobs. Moreover, in a case where the toner-empty state is judged on the premise that a steady amount of toner is supplied to the developing chamber, the developing chamber reaches the toner-empty state earlier than an estimated time after the monochrome image forming is resumed, which is likely to cause defective printing such as scraped images.

SUMMARY OF THE INVENTION

The present invention was conceived in view of the above problems, and in an image forming apparatus including a rotary developing apparatus that naturally supplies the toner from the toner storage to the developing chamber due to the rotation within a predetermined rotation range, it is an object of the present invention to enable a relatively stable amount of toner to be supplied to the developing chamber irrespective of the amount of toner remaining in the toner storage, when there arises a need to supply toner to the developing chamber during execution of a monochrome image forming job.

In order to fulfill the above-mentioned object, one aspect of the present invention is an image forming apparatus comprising a controller and a developing apparatus. The developing apparatus includes: a plurality of developer units each having a toner storage that stores toner therein and a developing chamber into which the toner is supplied from the toner storage; a rotary rack that accommodates the developer units radially therein; and a driver operable to drive the rotary rack to move each of the developer units to a developing position at which developing thereby is performed. Here, when each of the developer units is within a predetermined range of rotation, the toner stored in the toner storage thereof is supplied to the developing chamber by falling through a toner supply opening thereof. The controller includes: a judgement part operable to make a judgement whether or not an amount of toner in a developing chamber of a developer unit for the single color is equal to or less than a predetermined amount during execution of a monochrome image forming job which forms an image using toner of a single color. Here, the controller, if the judgement is affirmative, (i) suspends the execution, (ii) causes the driver to rotate the rotary rack in a manner that the developer unit for the single color (a) either stops within the predetermined range of rotation for a predetermined period of time, or passes through the predetermined range of rotation at a lower speed than when outside the predetermined range, and (b) moves to the developing position, and (iii) resumes the execution.

According to the above-mentioned structure, during execution of a monochrome image forming job which forms an image using toner of a single color, if the judgement part judges that an amount of toner in a developing chamber of a developer unit for the single color is equal to or less than a predetermined amount, the following control is executed: the monochrome image forming job is suspended; and the rotary rack is rotated so that the developer unit stops within a predetermined range of rotation for a predetermined period of time or passes through the predetermined range at a lower speed, and moves to the developing position again. Accordingly, this allows more time to supply the toner, thereby enabling the toner to be supplied from the toner storage to the developer unit more stably even when the amount of toner remaining in the toner storage becomes small.

That is to say, when the amount of toner in the toner storage is large, the amount of toner supplied to the developing chamber has a particular upper limit due to the capacity of the developing chamber, the height of the toner supply opening at the developing position, and the like. Accordingly, even when the amount of toner remaining in the toner storage gets low, so long as the remaining amount exceeds the above upper limit, an amount substantially equivalent to that supplied when the amount of toner in the toner storage is large can be achieved by making the rotary rack stop rotating for a period of time or slowing down the rotation speed within the range of rotation.

In addition, according to the above-stated structure, even when the whole amount of toner remaining in the developer unit is less than the amount of toner which needs to be steadily supplied to the developing chamber, the amount of the toner supplied from the toner storage to the developing chamber is larger than when the rotation speed is constant. Consequently, decrease of the amount of toner supplied to the developing chamber can be suppressed.

Additionally, another aspect of the present invention may be a control method for an image forming apparatus which includes a rotary developing apparatus accommodating a plurality of developer units, each using toner of a different color, in a rotary rack and is configured such that when each of the developer units is located within a predetermined range of rotation, toner stored in a toner storage thereof falls into a developing chamber, thereby supplying toner into the developing chamber, the rotary developing apparatus rotating the rotary in a predetermined rotational direction to bring a targeted one of the developer units to a developing position. Here, the control method comprises: a toner amount judging step of judging, during execution of a monochrome image forming job which forms an image using toner of a single color, whether or not an amount of toner in a developing chamber of a developer unit for the single color is equal to or less than a predetermined amount; an execution suspending step of, if the amount of toner is determined to be equal to or less than the predetermined amount, suspending the execution of the monochrome image forming job; a rotary rack stopping step of rotating the rotary rack and stopping the developer unit within the predetermined range of rotation for a predetermined period of time; a rotary rack rotating step of, upon elapse of the predetermined period of time, rotating the rotary rack to the developing position; and an execution resuming step of resuming the monochrome image forming job at the developing position.

Furthermore, another aspect of the present invention may be a control method for an image forming apparatus which includes a rotary developing apparatus accommodating a plurality of developer units, each using toner of a different color, in a rotary rack and is configured such that when each of the developer units is located within a predetermined range of rotation, toner stored in a toner storage thereof falls into a developing chamber, thereby supplying toner into the developing chamber, the rotary developing apparatus rotating the rotary in a predetermined rotational direction to bring a targeted one of the developer units to a developing position. Here, the control method comprises: a toner amount judging step of judging, during execution of a monochrome image forming job which forms an image using toner of a single color, whether or not an amount of toner in a developing chamber of a developer unit for the single color is equal to or less than a predetermined amount; an execution suspending step of, if the amount of toner is determined to be equal to or less than the predetermined amount, suspending the execution of the monochrome image forming job; a lower-speed rotating step of, while the execution of the monochrome image formation job is suspended, rotating the rotary rack in a manner that the developer unit passes through the predetermined range of rotation at a lower speed than in a range of the rotation other than the predetermined range; a rotary rack rotating step of rotating the rotary rack to the developing position; and an execution resuming step of resuming the monochrome image forming job at the developing position.

Execution of such a control method for the image forming apparatus achieves an effect equivalent to that achieved by the above-described image forming apparatus.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes an embodiment of an image forming apparatus of the present invention with reference to the drawings. The description is given by way of example of a four-cycle full-color printer using an intermediate transfer belt (hereinafter, this four-cycle full-color printer is referred to as simply "printer").

(1) Overall Structure of Printer

Figure 1:
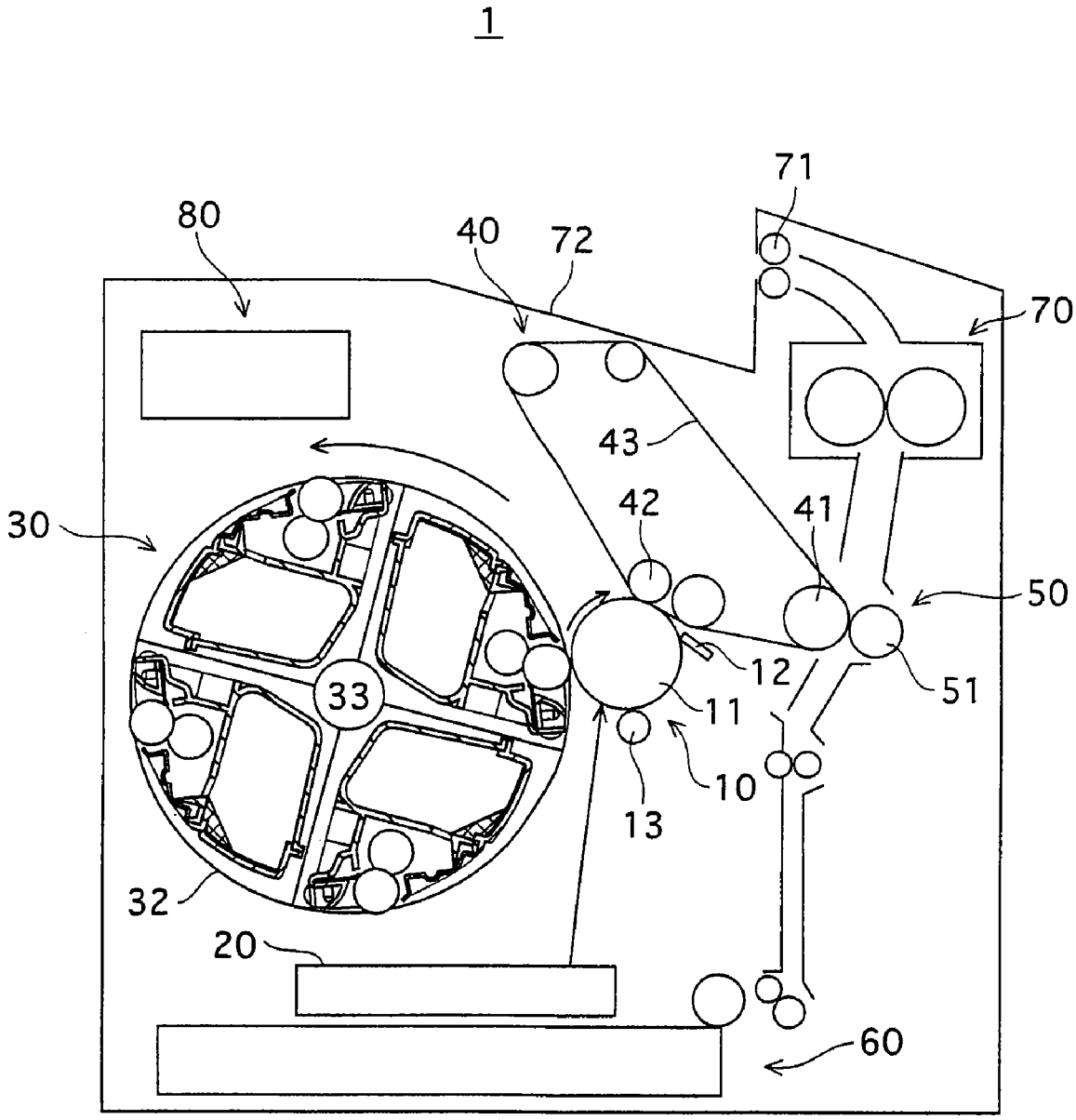
FIG. 1 shows a structure of a printer in accordance with an embodiment of the present invention.

As shown in FIG. 1, the printer 1 has a photosensitive part 10, an exposure scanner 20, a developing part 30, an intermediate transfer part 40, a secondary transfer part 50, a paper feeder 60, a fixing part 70, and a controller 80.

The photosensitive part 10 includes a photosensitive drum 11 that rotates in the direction of the arrow in FIG. 1. After residual toner is removed by a cleaning blade 12, the circumferential surface of the photosensitive drum 11 is uniformly charged by a charging roller 13, and is exposed to laser beam projected from the exposure scanner 20 to form an electrostatic latent image around the photosensitive drum 11.

The developing part 30 is of a rotary type, and FIG. 1 illustrates a cross-section in order to clearly show how the rotary rack 32 accommodates the developer units and the interior of each developer unit. (Other figures employ cross-sectional views as well for the same reason. Note that the toner in the developer units are not illustrated unless necessary.)

The electrostatic latent image formed around the photosensitive drum 11 is developed as a toner image by the developer unit of a corresponding color.

The intermediate transfer part 40 has an endless intermediate transfer belt 43 that is supported by a plurality of rollers including a driving roller 41. The driving roller 41 is controlled so that the intermediate transfer belt 43 runs at the same speed as the circumferential speed of the photosensitive drum 11.

The toner image formed around the photosensitive drum 11 is primarily transferred to the intermediate transfer belt 43 by a primary transfer roller 42.

A full-color image forming job (hereinafter, referred to as "color print job") is executed as follows. The processes of primary transfer of the respective color images of Y, M, C, and K are executed in sequence, and respective color images are superimposed onto the intermediate transfer belt 43 to form a full-color image. Subsequently in the secondary transfer part 50, a secondary transfer roller 51 secondarily transfers the full-color image onto a sheet of paper (unshown) that is fed by the paper feeder 60 in a timed relationship with the rotation of the intermediate transfer belt 43. Then, after the fixing part 70 fixes the full-color image on the sheet by heat, the sheet is ejected by ejection rollers 71 to an ejection tray 72.

On the other hand, when a monochrome-image forming job (hereinafter, referred to as "monochrome print job") using a black color is executed, only the developer unit of the black color is used to develop the image. The primary and secondary transfer operations are executed similarly to the above. When the image is fixed to a sheet of paper, the sheet is ejected.

It should be noted that, hereinafter, the above-described photosensitive part 10, exposure scanner 20, developing part 30, intermediate transfer part 40, secondary transfer part 50, paper feeder 60, and fixing part 70 are collectively referred to as "image forming part".

The controller 80, as described later, is mainly composed of a CPU and executes a print job by performing necessary processing on image data of the received job and controlling operations of each part included in the above-mentioned image forming part.

(2) Structure of Developing Part 30

Figure 2:
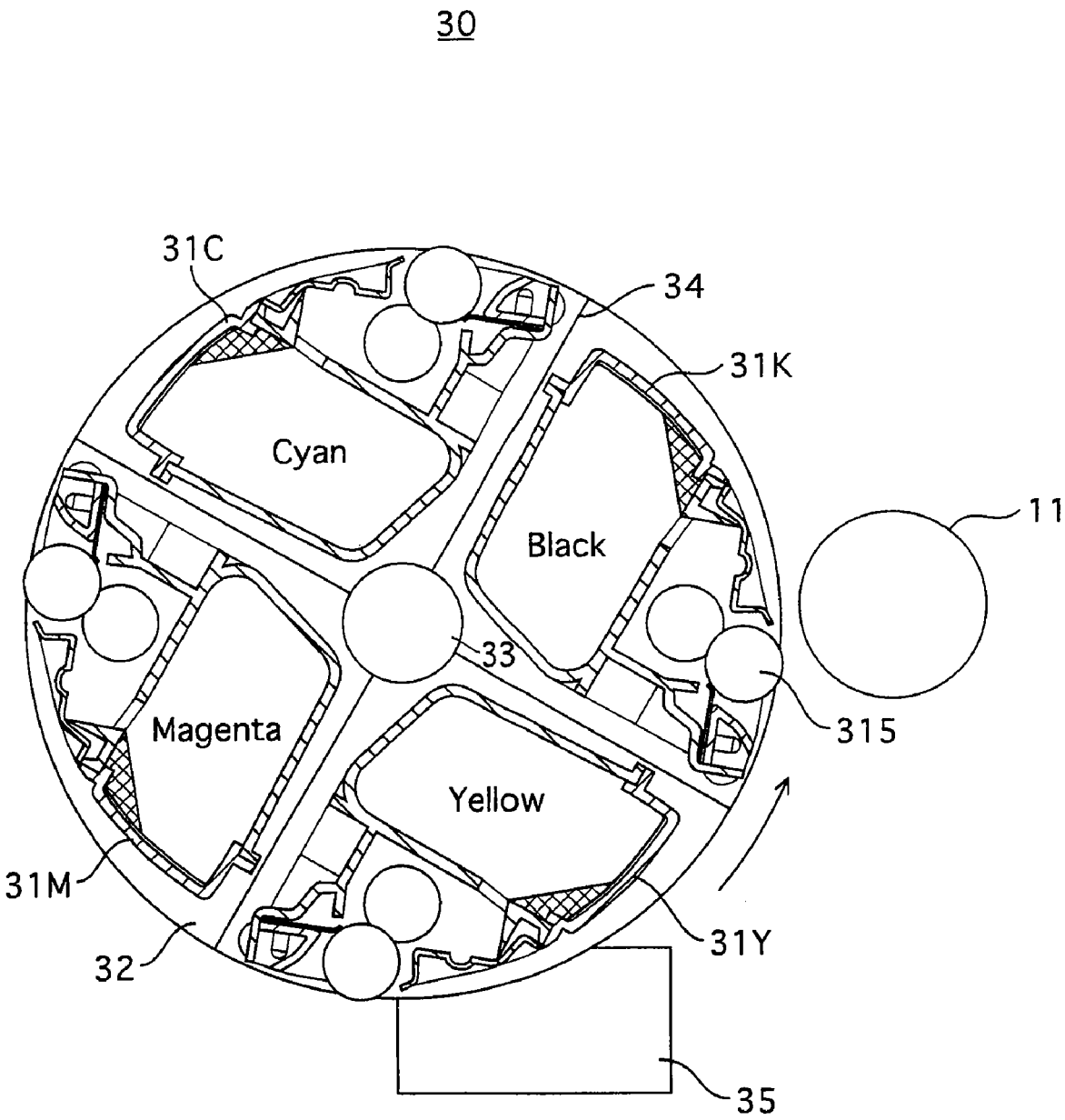
FIG. 2 shows a structure of a rotary developing part included in the printer.

As shown in FIG. 2, the developing part 30 has a rotary rack 32 and developer units 31. The rotary rack 32 accommodates the developer units 31Y, 31M, 31C, and 31K that store toner of Y, M, C and K colors, respectively. The rotary rack 32 is rotated around a rotation shaft 33.

The rotary rack 32 is substantially cylindrical. The interior of the rotary rack 32 is divided into four chambers by four partition parts 34 each forming a right angle with one another. Each chamber accommodates a corresponding one of the developer units 31Y, 31M, 31C, and 31K.

The outer circumference of each chamber of the rotary rack 32 can be opened so that the developer units 31Y, 31M, 31C and 31K can be replaced with a new developer unit. (The structure of how to open or close the chamber is omitted.)

The rotary rack 32 is driven to rotate in the direction of the arrow by a rotary rack driver 35 whose driving source is a servomotor or a stepping motor that can easily control positioning.

Note that FIG. 2 shows the rotational position of the rotary rack 32 at which the black developer unit 31K is in a waiting position. In this embodiment, this waiting position is a home position, and the controller 80 controls the rotary rack driver 35 so as to move the developing roller of each developer unit to the developing position that is in the proximity to the photosensitive drum 11.

Heretofore-known techniques are applied for controlling this positioning of the rotary rack 32. For example, in a case where a servomotor is used as the driving source of the rotary rack driver 35, the pulse number of the encoder from the home position to the developing position of each developer unit is predetermined and stored in a table in a ROM 84 (see FIG. 4 which is described later). Accordingly, positioning of the rotary rack 32 can be performed precisely by controlling the rotation of the servomotor while counting the pulses.

It should be noted that whether or not the rotary rack 32 is at the home position can be detected by, for example, as follows: a predetermined point on the rotary rack 32 is marked; a photoelectronic sensor is provided at a position so that the photoelectronic sensor detects the mark when the rotary rack 32 is at the home position and generates output signal accordingly; and consequently, whether or not the rotary rack 32 is at the home position can be detected based on the output signal from the photoelectronic sensor.

Figure 3:
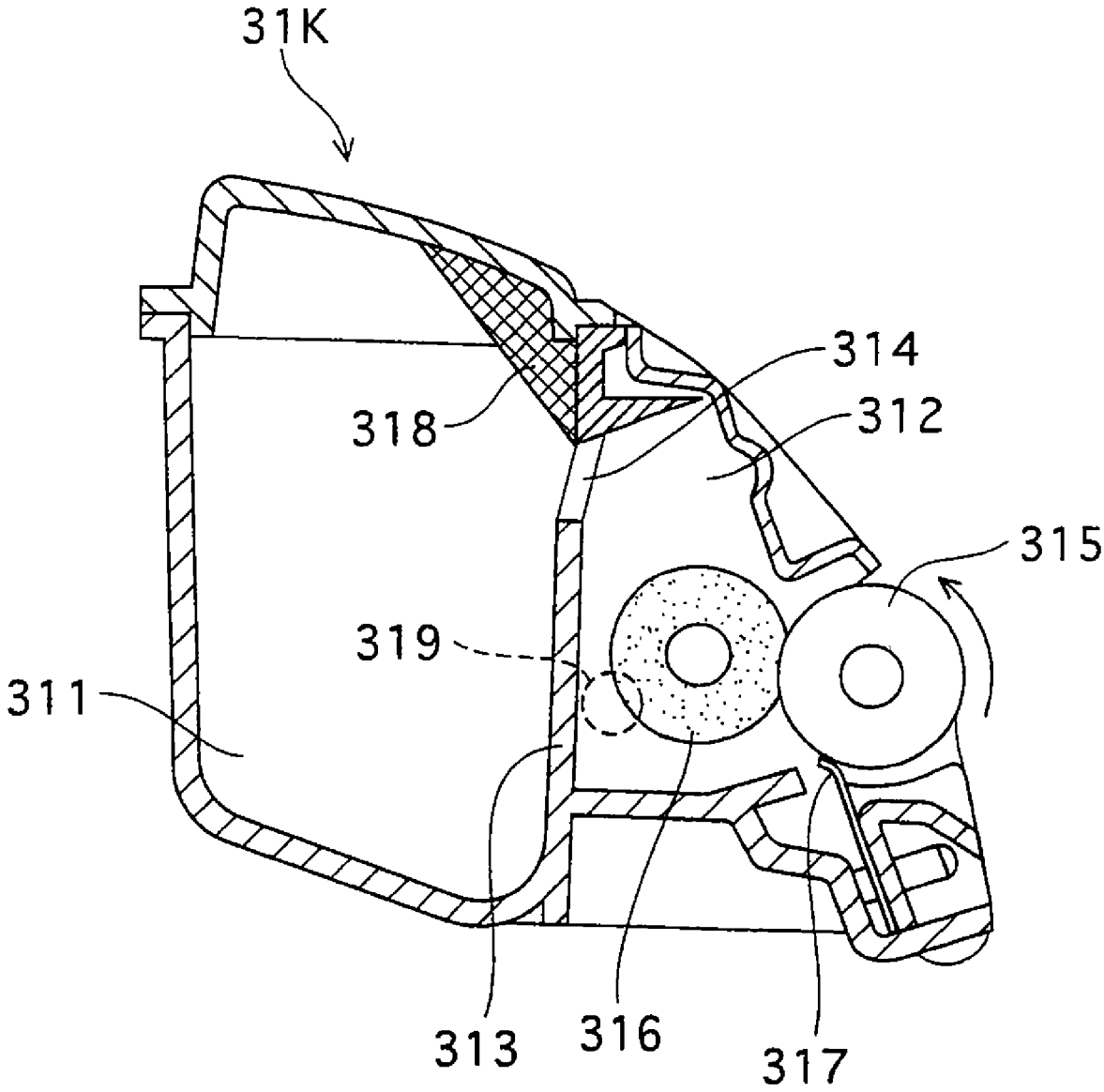
FIG. 3 is a cross-sectional view of a developer unit for black color included in the rotary developing part.

As shown in FIG. 3, the developer unit 31K includes a toner storage 311, a developing chamber 312 that is adjacent to the toner storage 311, a toner supply opening 314 of a partition wall 313 between the toner storage 311 and the developing chamber 312, a developing roller 315 that supplies toner to the surface of the photosensitive drum 11, a supply roller 316 that supplies the toner in the developing chamber 312 to the developing roller 315, a regulating blade 317 that makes a layer of the toner on the surface of the developing roller 315 be in a uniform thickness, and a slope 318 that allows a smooth flow of the residual toner from the toner storage 311 to the developing chamber 312.

The outer circumference of the supply roller 316 is made of a foamed elastic material such as a sponge, which enables the supply roller 316 to carry a large amount of toner. In addition, the distance between the shafts of the development roller 315 and the supply roller 316 can be a little shorter so that the area in which the developing roller 315 contacts with the supply roller 316 can be enlarged. Thus, with the above structures, toner can be more efficiently supplied to the developing roller 315.

Both rotational shafts of the developing roller 315 and the supply roller 316 project out from the surface of the developing chamber 312. The developing roller 315 and the supply roller 316 are driven to rotate in a predetermined direction by a publicly-known driving mechanism that is unshown in the figure. This driving mechanism is as follows, for example. At each projecting edge of the developing roller 315 and the supply roller 316, a spur gear or the like is fixed. When the developer unit 31K reaches the developing position, the spur gear is meshed with a gear connected to another driving source.

Note that other developer units 31Y-31C have the identical structure with the developer unit 31K except for the toner color.

(3) Structure of Controller 80

Figure 4:
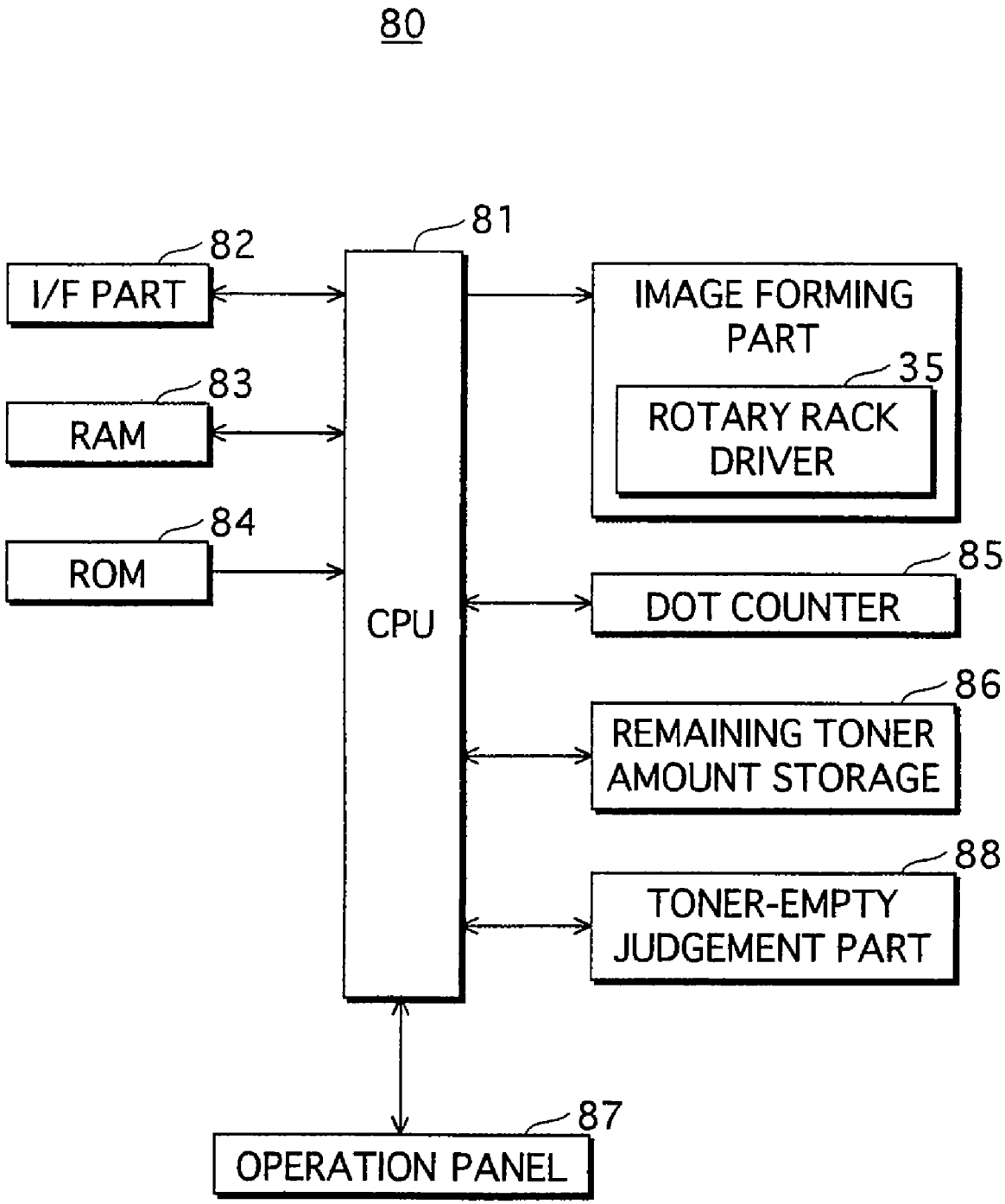
FIG. 4 is a block diagram showing a structure of a controller.

As shown in FIG. 4, the controller 80 is mainly composed of a CPU 81, an interface (I/F) part 82, a RAM 83, a ROM 84, a dot counter 85, a remaining toner amount storage 86, a toner-empty judgement part 88, and an operation panel 87.

The interface part 82 is used to perform communication between an external terminal device connected via a LAN or the like and the CPU 81, and is composed of a LAN card, a LAN board, and the like.

The RAM 83 is a volatile memory which is a work area where the CPU 21 executes programs.

The ROM 84 stores therein programs which control operations of each part of the image forming part and programs for data-processing and the like.

The dot counter 85 counts the number of dots included in image data of each color per page during image forming processing. The remaining toner amount storage 86 stores therein amounts of toner remaining in the respective developer units, calculated by the CPU 81 based on the count values by the dot counter 85. Additionally, based on the amount of toner remaining in the developing chamber, which is stored in the remaining toner storage unit 86, the toner-empty judgement part 88 judges whether black toner is required to be supplied or not. Details of these are described later.

The operation panel 87 receives necessary setting from a user.

The CPU 81, upon receiving image data of R, G, and B of a print job from the external terminal, (i) converts the received image data to image data of Y, M, C, and K, (ii) reads, from the ROM 84, programs required for image formation, and (iii) executes smooth image forming operations by integrally controlling each part with appropriate timing. In particular, when executing a monochrome print job, the CPU 81 controls the rotary rack driver of the image forming part in a manner such that the toner is stably supplied to the developing chamber 312, as described in the following.

(4) Control Operation during Execution of Monochrome Print Job

Described below is a control operation, among controls executed by the controller 80, during monochrome print job processing.

Figure 5:
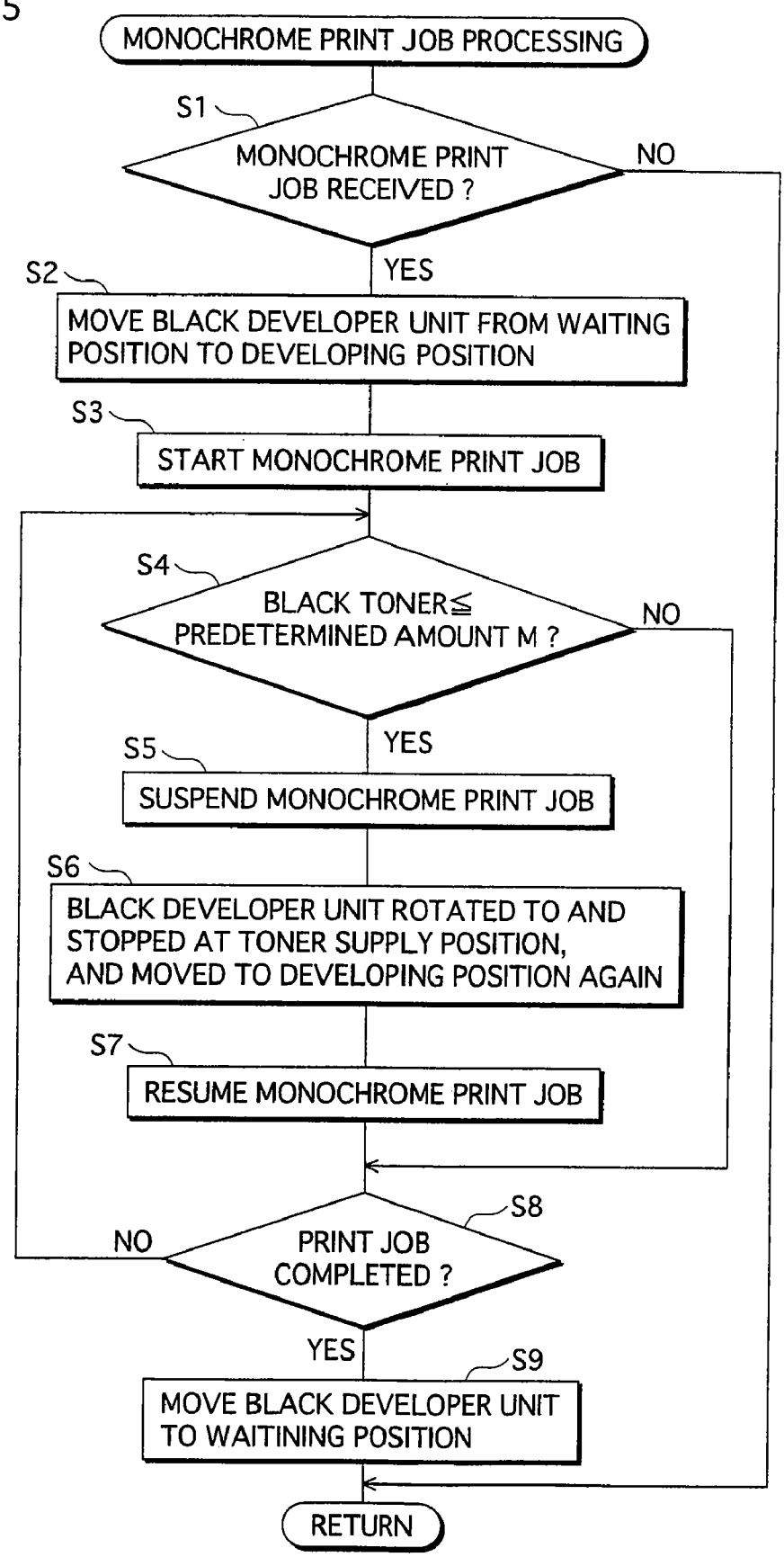
FIG. 5 is a flowchart showing contents of control executed by the controller on monochrome print job processing.
Figure 6:
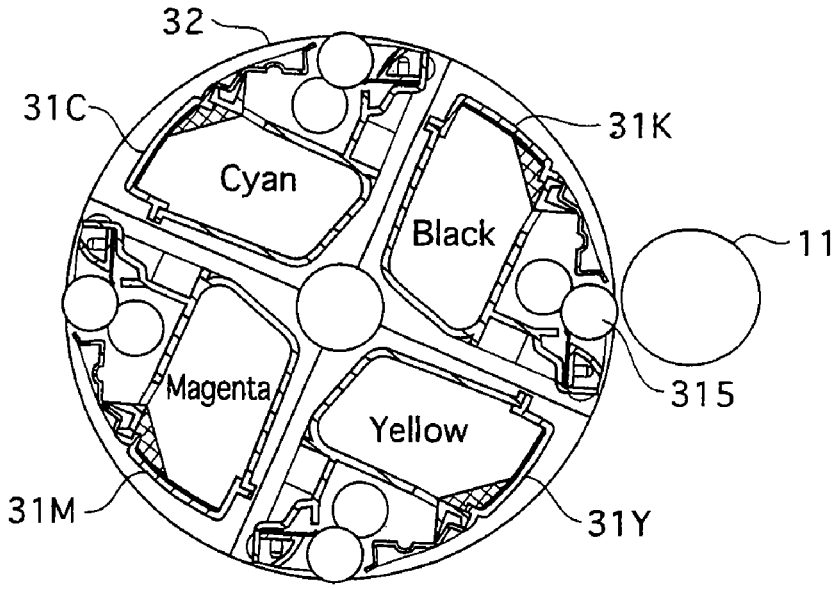
FIG. 6 shows the rotary developing part when the developer unit for black is positioned at the developing position.

As shown in FIG. 5, upon receiving a monochrome print job from an external terminal (step S1: YES), the controller 80 controlls the rotary rack driver to bring the black developer unit 31K from the waiting position (see FIG. 2) to the developing position (see FIG. 6) by rotating the rotary rack 32 of the developing part 30 in a counterclockwise direction (step S2).

At ordinary offices, monochrome print jobs arise more frequently than full-color print jobs. Accordingly, in the present embodiment, as shown in FIG. 2, when the developer 31K is at the waiting position, the developing roller 315 thereof is positioned close, on the upstream side in the rotating direction, to the developing position. This minimizes the time required for the developer 31K to be brought to the developing position, thereby reducing the period of time preceding the start of the first print in a monochrome print job.

It should be noted that in general, data of the print job received from an external terminal is composed of print data and header information which includes a print condition. Consequently, based on the header information, it can be easily determined whether the print job is a monochrome print job or a full-color print job.

Upon bringing the developer unit 31K to the developing position, the controller 80 starts executing the monochrome print job (step S3). That is to say, the controller 80 (i) converts, for each page, the print data among the data in the received print job into a bitmap image, (ii) temporarily stores the converted data in the RAM 83, (iii) sequentially reads the stored data, and (iv) makes the image forming part form a monochrome image on each recording sheet based on the read data, thereby outputting each formed image.

During this monochrome print job processing, it is judged whether the amount of black toner in the developing chamber 312 of the developer unit 31K is equal to or less than a predetermined amount M by the toner-empty judgement part 88 (step S4).

If the amount of toner in the developing chamber 312 is equal to or less than a predetermined amount, the amount of toner supplied to the developing roller 315 decreases, causing image deterioration such as scraped images as a result. Thus, it is desirable that the amount of toner in the developing chamber 312 exceeds the predetermined amount. Accordingly, "the predetermined amount M" in the step S4 is set at an amount that is slightly more than the amount of toner in the developing chamber 312 at which the image deterioration begins to occur. The specific value is predetermined based on experiments conducted during a design phase or before shipment, and stored, for instance, in the ROM 84 (FIG. 4).

As a method to detect the amount of toner in the developing chamber 312, a publicly known method is applied. In the present embodiment, the remaining amount of toner is detected by counting the number of dots when the print data to be printed is converted into bitmap data.

In other words, for every printed page, the number of pixels (dots), in the bitmap data, to be printed is counted by the dot counter 85 (FIG. 4), and the counted value is transmitted to the CPU 81.

The remaining toner amount storage 86 includes a table for storing one or more predetermined remaining amounts of toner for each of the developer units 31Y to 31K.

Specifically, for the developer unit 31K, two kinds of remaining amounts of toner are stored. The two kinds are (a) total toner amount which is the sum of amounts of toner remaining in the toner storage 311 and the developing chamber 312 and (b) developing chamber toner amount which is the amount of toner remaining in the developing chamber 312. For the other developer units 31Y to 31C, the total toner amount is stored for each color.

The total toner amount is reset to a default value (hereinafter, referred to as "first default value") when the developer unit is replaced with a new developer unit of a corresponding color. The first default value of a new developer unit that shows the number of dots printable by the developer unit is determined by calculations or experiments. The first default value is stored in the ROM 84 and read out when resetting.

Whether a developer unit is replaced with a new developer unit or not is determined by applying a publicly known technique. One example of application of such a technique is as follows. A limit switch is provided at the installation position of each developer unit in the rotary rack 32. The limit switch is set to turn OFF when the developer unit is removed. Based on this setting, the developer unit can be determined to have been replaced when the output from the limit switch has changed ON->OFF->ON. Another example is the use of IC tags, as in the following. An IC tag which stores information such as a product number is attached to the developer unit 31. By providing an IC reader, which reads information stored in the IC tag, on a lateral surface of the rotary rack 32 of the printer 1, the developer unit can be determined to have been replaced when the product number read by the IC reader has changed.

Alternatively, as a simple method, a user or a service person can perform corresponding input from the operation panel 87 when the developer unit is replaced.

The developing chamber toner amount of the developer unit 31K is reset every time the rotary rack 32 rotates 360 degrees. This is because, as described later, the rotary rack 32 is stopped at a predetermined rotational position during each 360-degree rotation, thereby allowing a predetermined amount of toner to be supplied from the toner storage 311 to the developing chamber 312.

The developing chamber toner amount is reset to a second default value which is stored in the ROM 84. The second default value, for example, can be the number of dots, which is determined by calculations and experiments, printable without image deterioration when an average amount of toner is supplied from the toner storage 311 to the developing 312 under a condition such as the following: the rotary rack 32 stops at a rotational position P1 (which is described later) for a predetermined time T1 when the amount of toner remaining in the toner storage 311 is ample.

Upon replacement of the developer unit of a given color, the CPU 81 resets the total toner amount stored in the remaining toner amount storage 86 with the first default value, and, every time the count value is transmitted from the dot counter 85, updates the total toner amount by subtracting therefrom the transmitted count value. The CPU 81, when the value of the total toner amount is close to "0", reminds the user to replace the toner by generating a corresponding display on the liquid-crystal panel or the like of the operation panel 87, and when this value is "0", prohibits printing operation.

Each time the rotary rack 32 rotates 360°, the CPU81 resets the developing chamber toner amount of the developer unit 31K in the remaining toner amount storage 86 to the second default value, and each time the count value of a page printed in black is transmitted from the dot counter 85, updates the developing chamber toner amount by subtracting therefrom the transmitted count value.

It should be noted that since the CPU 81 itself controls the rotational operation of the rotary rack 32, whether or not the developing chamber toner amount requires to be reset, that is to say, whether or not the rotary rack 32 has rotated 360 degrees, can be easily determined.

At a step S4 in FIG. 5, the toner-empty judgement 88 part judges, by referring to the contents stored in the remaining toner amount storage 86, whether or not the developing chamber toner amount of the developer unit 31K is equal to or less than the predetermined amount M. If the developing chamber toner amount of the developer unit 31K is equal to or less than the predetermined amount M, the monochrome print job is suspended (step S4: YES, step S5).

In this case, the toner and recording sheet are not wasted if the monochrome print job is suspended upon completion of printing of the page which is currently being printed.

Next, the black developer unit 31K is brought to the toner supply position by rotating the rotary rack 32, stopped there for a period of time, and brought back to the developing position again (step S6).

Figure 7:
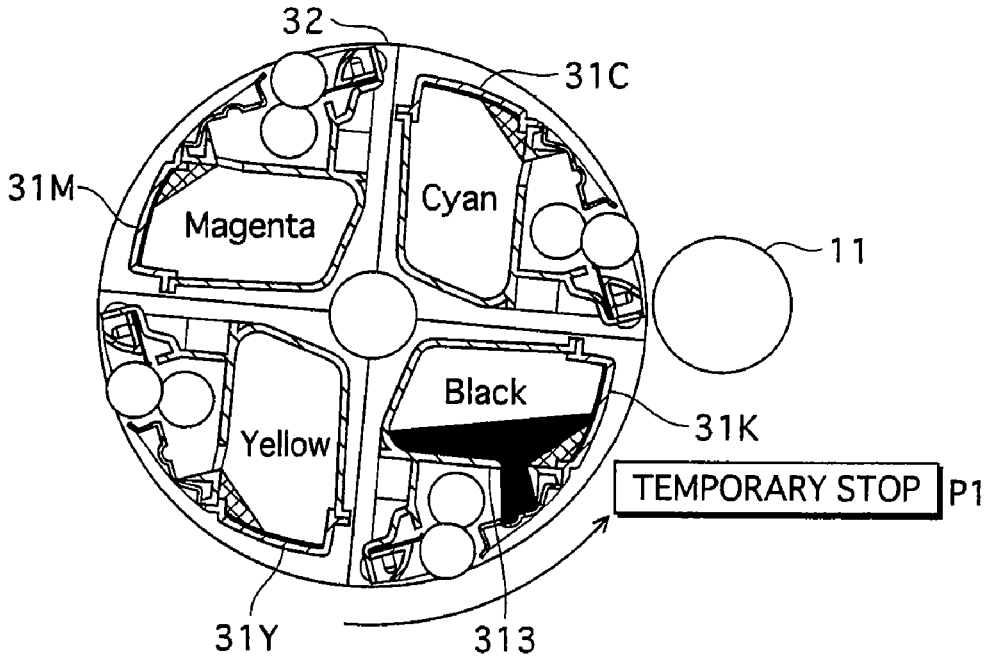
FIG. 7 shows how the black developer unit is brought from the developing position to a toner supply position.

As shown in FIG. 7, the rotation is stopped at the supply position P1. At this position, the toner storage 311 of the developer unit 31K is located higher than the developing chamber 312, and the partition 313 which separates the toner storage 311 and the developing chamber 312 is substantially horizontal. These cause the toner to fall and flow into the developing chamber 312 from the toner storage 311 through the toner supply opening 314.

While the T1, the period of time during which the rotation is stopped to supply the toner, varies depending on the shape of the toner storage 311 and the size of the toner supply opening 314, for example, a period of approximately 0.5 second is appropriate. By providing such a stop period, the required amount of toner can be steadily supplied to the developing chamber 312 even if the supply speed slows down with decrease of the toner remaining in the toner storage 311.

Referring back to FIG. 5, subsequent processes are as follows. After the toner is forcibly supplied at the toner supply position, the monochrome print job is resumed with the developer unit 31K brought to the developing position (step S7). If the print job is not completed (step S8: NO), the process goes back to the step S4 to continue the monochrome print job. If the print job is completed (step S8: YES), the process goes to a step S9 at which the CPU 81 brings the black developer unit 31K to the waiting position shown in FIG. 2 by rotating the rotary rack 32 in the counterclockwise direction (step S9), and the process returns to the main routine (unshown) which controls the entire operations of the printer 1.

It should be noted that by stopping the rotary rack 32 at the toner supply position P1 for a certain period of time while rotating the rotary rack 32 to the waiting position in the step S9, a stable amount of toner can be supplied to the developing chamber 312. This facilitates the determination at the step S4 when executing the next monochrome print job and increases the interval before the next forced supply of toner, and thus is preferable in terms of processing efficiency as well.

Figure 8:
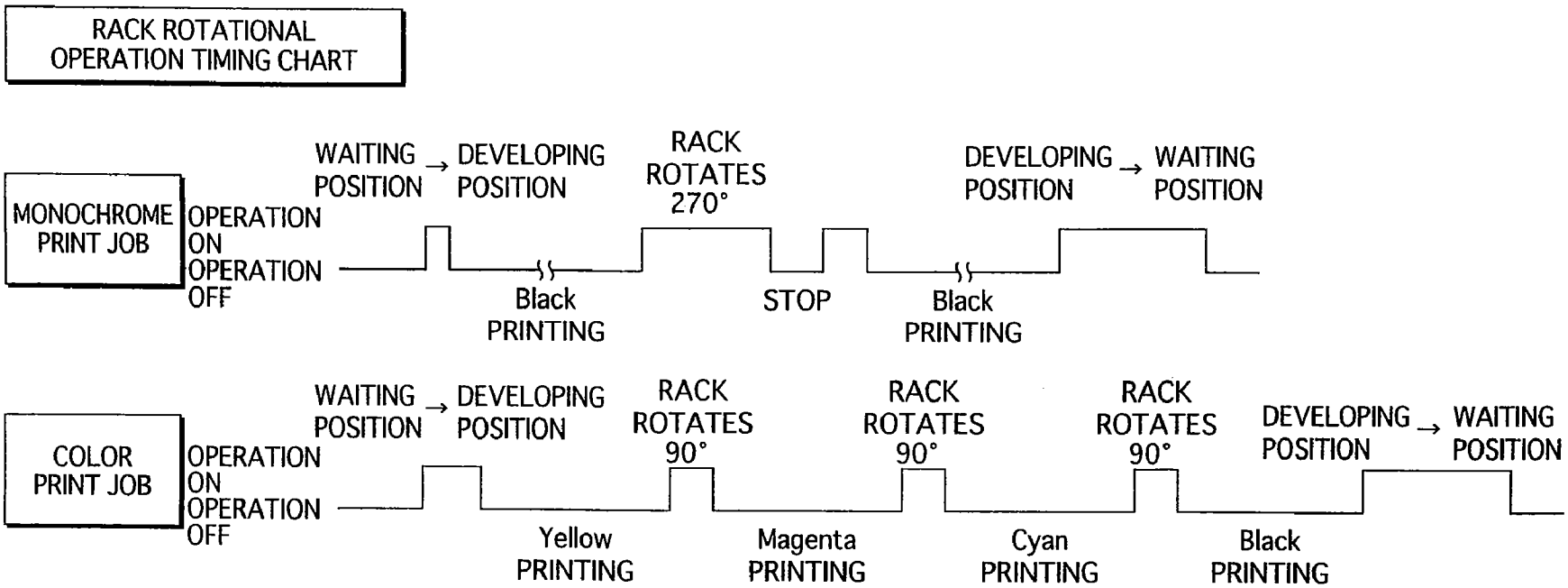
FIG. 8 shows timing charts of rotational movements of a rotary rack in a monochrome print job and a full-color print job, respectively.

FIG. 8 is a timing chart showing the contents of controls executed on the rotational operations of the rotary rack 32 when performing a monochrome print job and performing a full-color print job.

Note that part of the timing chart relating to the monochrome print job is omitted, as numerous black images are printed consecutively.

The processes shown in FIG. 8 are executed as follows. After the black developer unit 31K reaches the developing position at the beginning of a monochrome print job, printing is executed. When the developing chamber toner amount falls to or below the predetermined amount M, the printing operation is suspended, and the rotary rack 32 is rotated approximately 270° and stopped at the toner supply position for the toner supply. Following that, the developer unit 31K is brought to the developing position again to resume printing. Upon completion of printing of all the pages, the rotary rack 32 is rotated to bring the developer unit 31K to the waiting position and waits for the execution of the next print job.

When performing a full-color print job, the yellow developer unit 31Y is brought to the developing position at the beginning of the print job, and yellow printing is executed. After that, each of the developer units 31M, 31C, and 31K is brought to the developing position in sequence by rotating the rotary rack 32 by 90° at a time, thereby executing printing in each color of magenta, cyan, and black. Upon completion of the printing, the developer unit 31K is brought from the developing position to the waiting position, and the print job is completed.

Note that when multiple pieces of full-color prints are to be made, the rotary rack 32 is not brought to the waiting position after executing black printing but executes printing in each color repeatedly by rotating by 90° at a time.

<Modifications>

While the present invention is described based on the above embodiment, the present invention is never limited to the above embodiment, and various modifications can be made as follows.

(1) In the above-mentioned embodiment, a dot counter is applied to detect the amount of toner remaining in the developing chamber 312. However, another publicly-known method can be employed. For instance, a transparent window may be provided at a given position on a wall surface of the developing chamber 312 (when the developer unit is at the developing position, with the amount of toner in the developing chamber 312 thereof being equivalent to the "predetermined amount M", this position corresponds to the upper surface of the toner in the developing chamber 312) and the remaining amount of toner can be detected from outside the window using a reflective photoelectric sensor 319 (see the part indicated by broken lines in FIG. 3) or the like.

Additionally, the amount of toner in the developing chamber 312 can be simply estimated to be equal to or less than the "predetermined amount M" in cases such as follows: the number of consecutive prints made during a monochrome print job is counted by the CPU 81, and the counted value exceeds a predetermined number of sheets (for example, 200 sheets); elapsed time from the beginning of a monochrome print job is measured by the CPU 81, and the duration of the job is equal to or greater than a predetermined time (for example, 5 minutes).

(2) In the above-mentioned embodiment, irrespective of the total toner amount, the toner supply position at which the rotary rack 32 stops for toner supply is constant, and the stop period is constant as well.

When the toner remaining in the toner storage 311 is equal to or more than a certain amount, the predetermined amount of toner can be stably supplied to the developing chamber 312. However, when the toner remaining in the toner storage 311 decreases to a very small amount, efficiency of the toner supply may drop considerably. In addition, the toner remaining in the toner storage 311 tends to reside locally. Thus, it is more preferable to vary the stop period and the toner supply position (rotational angle) accordingly.

In the following, description is given on contents of control performed by the controller 80 in a case where the toner supply position (stop position) is varied according to the amount of toner remaining in the toner storage 311. Since the contents are identical to those in the above-mentioned embodiment except for the step S6 of the flowchart in FIG. 5, steps S61 to S64 which replace the step S6 are described in detail based on FIG. 9.

Figure 9:
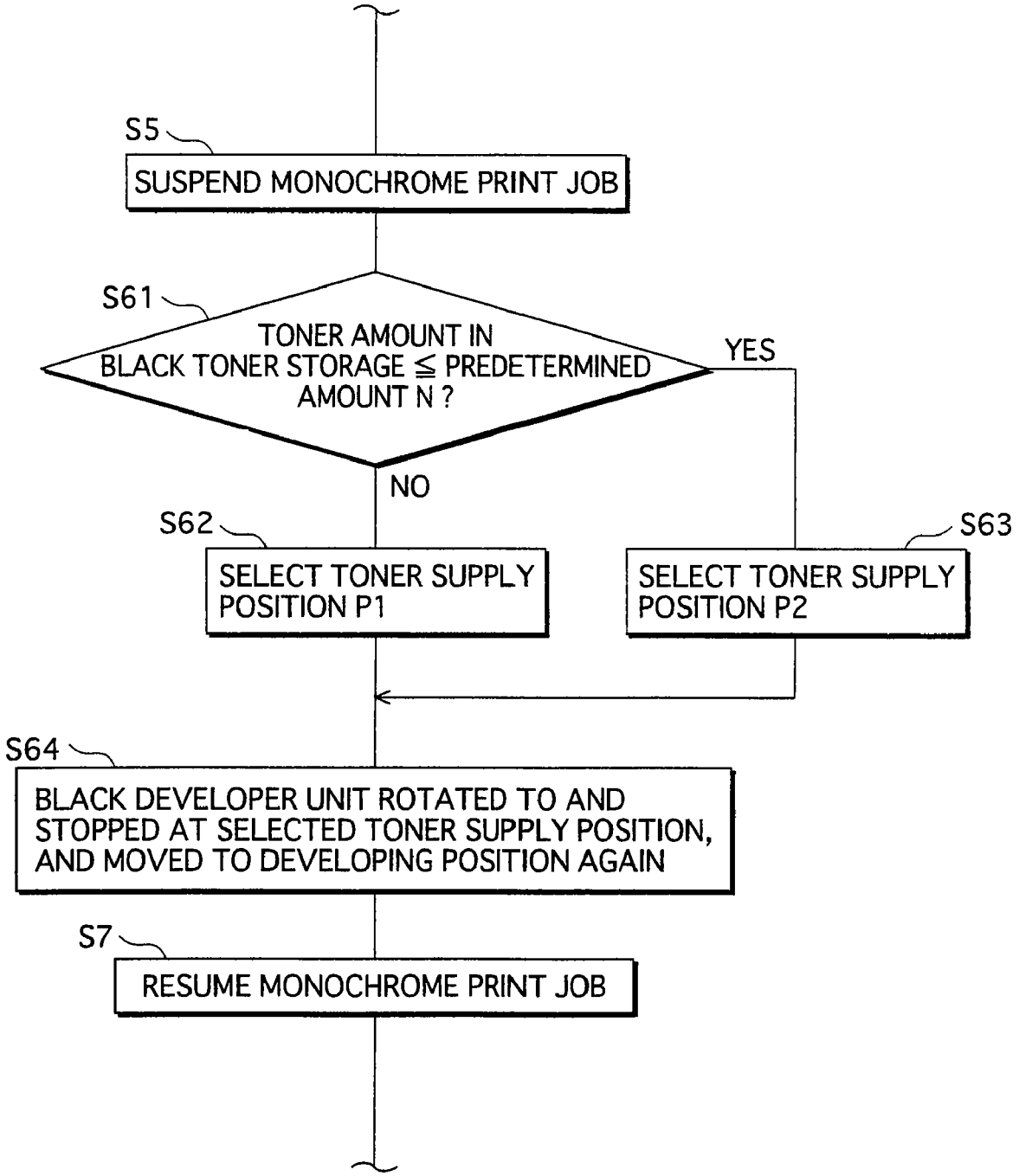
FIG. 9 is a partial flowchart showing characteristic control of monochrome print job processing of a modification.

As shown in FIG. 9, upon the suspension of the monochrome print job at the step S5, it is judged whether or not the amount of toner in the toner storage 311 (storage toner amount) of the developer unit 31K is equal to or less than a predetermined amount N.

The amount of toner in the toner storage 311 can be determined by subtracting the developing chamber toner amount from the total toner amount stored in the remaining toner amount storage 86. In addition, the predetermined amount N can be empirically determined by experiments. For instance, an experiment which determines the amount of toner supplied to the developing chamber 312 during the stop period at the supply position for a predetermined time during a 360-degree rotation by the rotary rack 32 can be repeated while gradually decreasing the amount of toner in the toner storage 311. If the amount of toner supplied to the developing chamber 312 changes significantly, the amount of toner in the toner storage 311 which immediately precedes the change can be specified as the predetermined amount N.

Figure 10A:
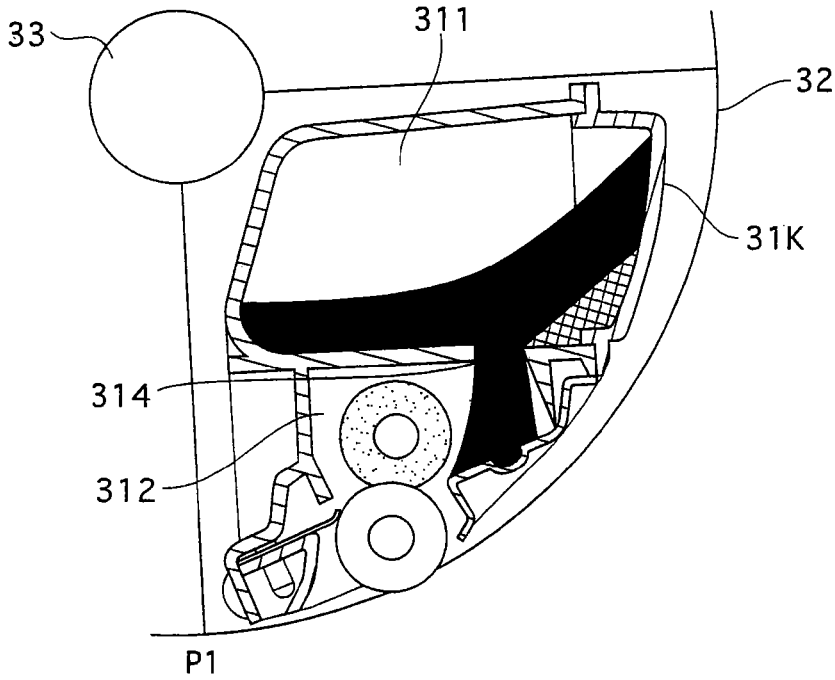
FIG. 10A and FIG. 10B show toner supply positions P1 and P2, of the black developer unit, indicated in the partial flowchart in FIG. 9.
Figure 10B:
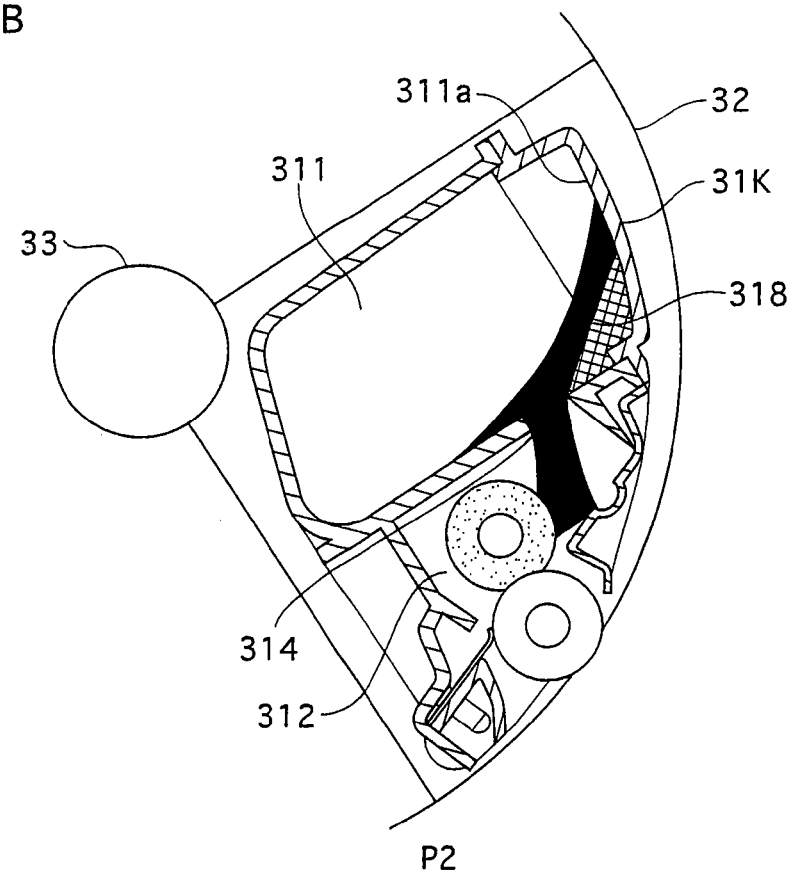

If the amount of toner in the toner storage 311 is greater than the predetermined amount N, the toner supply position P1 as shown in FIG. 10A is selected as the stop position (step S61: NO, step S62), and if the amount of toner in the toner storage 311 is equal to or less than the predetermined amount N, a toner supply position P2 as shown in FIG. 10B is selected as the stop position (step S61: YES, step P63).

The toner supply position P2 is reached by further rotating the rotary rack 32 in the counterclockwise direction by a given angle from the toner supply position P1. As shown in FIG. 10B, when the amount of toner in the toner storage 311 decreases, a small amount of toner tends to remain around an inner wall part 311*a* of the toner storage 311 while the rotary rack 32 rotates. At the toner supply position P2, since the slope surface of a slope 318 is a little closer to vertical, the toner remaining on the inner wall part 311*a* smoothly slides down the slope surface into the developing chamber 312, ensuring that the toner is stably supplied to the developing chamber 312.

It should be noted that in the example in FIG. 9, the toner supply position is changed according to the amount of toner in the toner storage 311. However, along with this, or alternatively, the stop period at the toner supply position can be varied. In this case, when the amount of toner in the toner storage 311 is equal to or less than the predetermined amount N at the S61, control is performed so that the stop period is T2 that is longer than the stop period T1 which is applied when the amount of toner in the toner storage 311 is more than the predetermine amount N. A suitable value of the stop period T2 can be also determined by experiments.

In addition, in the present example, the amount of toner in the toner storage 311 is judged based on one threshold. However, two or more thresholds can be provided to vary the toner supply position and/or stop period in a multistage manner as the storage toner amount decreases. This further ensures the stable supply of toner.

(3) According to the structure of the above-described embodiment, the rotary rack 32 is rotated to a particular supply position and stopped for a particular period of time when the developing chamber toner amount falls below the predetermined amount M during execution of a monochrome print job. However, when the toner storage 311 is in an upper position with respect to the developing chamber 312, and the area of the projected image, in a horizontal direction, of the toner supply opening 314 is of a particular size or greater, it is assumed that the toner in the toner storage 311 can be supplied to the developing chamber 312. Thus, in each developer unit, the toner can be supplied to the developing chamber 312 within a certain range of rotational angle. Accordingly, by slowing down the rotational speed of the rotary rack 32 within the range of rotational angle at which the toner can be supplied (hereinafter, referred to as "toner suppliable range"), compared to the rotational speed outside the range, the time required for the developing chamber to pass through the range becomes longer. As a result, an effect equivalent to or close to the that produced by stopping the rotary rack 32 at the supply position can be achieved.

It should be noted that the stable toner supply can also be achieved by slowing down the rotational speed within the entire rotational range including the toner suppliable range. In this case, however, the rotary rack 32 requires an unnecessarily long period of time to rotate 360 degrees, which is not desirable from the viewpoint of efficient processing of monochrome print jobs. Thus, it is preferable that the rotary rack 32 rotates as rapidly as possible outside the toner suppliable range, slows down the rotational speed or stopping only within the toner suppliable range, and subsequently rotates rapidly again to the developing position.

Additionally, in this modification also, as is the case with (2), the rotational speed of the rotary rack 32 within the toner suppliable range can be slowed down further as the amount of toner in the toner storage 311 decreases.

(4) It should be noted that in a case where the developing chamber toner amount is estimated by the dot counter, as in the above-described embodiment, when the total toner amount falls below the amount of toner which needs to be stably supplied, the actual developing chamber toner amount may decrease below the predetermined amount M before the developing chamber toner amount is determined to be equal to or less than the predetermined M according to the estimation based on the dot counter. This causes phenomenon such as scraped images.

In such a case, when the reset is performed, the developing chamber toner amount can be reset, not to the second default value, but to the number of dots printable by the total toner amount. It should be noted here that depending on the shape of the toner storage, not all the toner is supplied to the developing chamber 312, but part of the toner remains as residue (hereinafter, the toner remaining as residue is referred to as "unsuppliable toner"). In this case, the developing toner amount should be reset to the number of dots printable by the toner amount which is determined by deducting the amount of unsuppliable toner from the total toner amount.

(5) Furthermore, the above embodiment is described on the premise that the monochrome print job is executed in black color. However, control equivalent to that in the above-described embodiment is performed when a monochrome print job can be executed in other colors. In this case, the remaining toner amount storage 86 also stores therein the developing chamber toner amounts of the developer units of the colors, other than black, which can be used in the monochrome print job as well.

(6) In the above embodiment, a full-color printer is given by way of example of the image forming apparatus in accordance with the present invention. However, the image forming apparatus in accordance with the present invention may be a copy machine or a color facsimile apparatus having the printer, or a complex machine having all these functions.

Although the present invention has been fully described by way of examples with reference to the accompanying drawings, it is to be noted that various changes and modifications will be apparent to those skilled in the art.

Therefore, unless such changes and modifications depart from the scope of the present invention, they should be construed as being included therein.

What is claimed is:

1. An image forming apparatus comprising a controller and a developing apparatus, the developing apparatus including:

a plurality of developer units each having a toner storage that stores toner therein and a developing chamber into which the toner is supplied from the toner storage;

a rotary rack that accommodates the developer units radially therein; and a driver operable to drive the rotary rack to move each of the developer units to a developing position at which developing thereby is performed, wherein when each of the developer units is within a predetermined range of rotation, the toner stored in the toner storage thereof is supplied to the developing chamber by falling through a toner supply opening thereof, and the controller including:

a judgment part operable to make a judgment whether or not an amount of toner in a developing chamber of a developer unit for the single color is equal to or less than a predetermined amount during execution of a monochrome image forming job which forms an image using toner of a single color, wherein the controller, if the judgment is affirmative, (i) suspends the execution, (ii) causes the driver to rotate the rotary rack in a manner that the developer unit for the single color (a) either stops within the predetermined range of rotation for a predetermined period of time, or passes through the predetermined range of rotation at a lower speed than when outside the predetermined range, and (b) moves to the developing position, and (iii) resumes the execution, wherein the developing apparatus further includes a storage toner amount detector operable to detect an amount of toner remaining in a toner storage of the developer unit for the single color, and the controller refers to a detection signal output from the storage toner amount detector and performs a control in a manner such that the developer unit for the single color stops in the predetermined range of rotation for a longer period of time as the amount of toner remaining in the toner storage decreases.

2. An image forming apparatus comprising a controller and a developing apparatus, the developing apparatus including:

a plurality of developer units each having a toner storage that stores toner therein and a developing chamber into which the toner is supplied from the toner storage;

a rotary rack that accommodates the developer units radially therein; and a driver operable to drive the rotary rack to move each of the developer units to a developing position at which developing thereby is performed, wherein when each of the developer units is within a predetermined range of rotation, the toner stored in the toner storage thereof is supplied to the developing chamber by falling through a toner supply opening thereof, and the controller including:

a judgment part operable to make a judgment whether or not an amount of toner in a developing chamber of a developer unit for the single color is equal to or less than a predetermined amount during execution of a monochrome image forming job which forms an image using toner of a single color, wherein the controller, if the judgment is affirmative, (i) suspends the execution, (ii) causes the driver to rotate the rotary rack in a manner that the developer unit for the single color (a) either stops within the predetermined range of rotation for a predetermined period of time, or passes through the predetermined range of rotation at a lower speed than when outside the predetermined range, and (b) moves to the developing position, and (iii) resumes the execution, wherein the developing apparatus further includes a storage toner amount detector operable to detect an amount of toner remaining in a toner storage of the developer unit for the single color, and the controller refers to a detection signal output from the storage toner amount detector and performs a control in a manner such that a stop position within the predetermined range of rotation changes in accordance with the amount of toner remaining in the toner storage.

3. The image forming apparatus of claim 1, wherein the judgment part makes the judgment based on an amount of toner consumed during the monochrome image forming job.

4. An image forming apparatus comprising a controller and a developing apparatus, the developing apparatus including:

a plurality of developer units each having a toner storage that stores toner therein and a developing chamber into which the toner is supplied from the toner storage;

a rotary rack that accommodates the developer units radially therein; and a driver operable to drive the rotary rack to move each of the developer units to a developing position at which developing thereby is performed, wherein when each of the developer units is within a predetermined range of rotation, the toner stored in the toner storage thereof is supplied to the developing chamber by falling through a toner supply opening thereof, and the controller including:

a judgment part operable to make a judgment whether or not an amount of toner in a developing chamber of a developer unit for the single color is equal to or less than a predetermined amount during execution of a monochrome image forming job which forms an image using toner of a single color, wherein the controller, if the judgment is affirmative, (i) suspends the execution, (ii) causes the driver to rotate the rotary rack in a manner that the developer unit for the single color (a) either stops within the predetermined range of rotation for a predetermined period of time, or passes through the predetermined range of rotation at a lower speed than when outside the predetermined range, and (b) moves to the developing position, and (iii) resumes the execution, wherein the consumed amount of toner is determined based on a number of dots formed during the monochrome image forming job.

5. The image forming apparatus of claim 4, wherein the judgment part makes the judgment based on a number of sheets on which image formation has been performed during the monochrome image forming job.

6. The image forming apparatus of claim 4, wherein the judgment part makes the judgment based on a duration of the monochrome image forming job.

7. The image forming apparatus of claim 4, wherein the developing apparatus further includes a sensor operable to detect the amount of toner, and the judgment part makes the judgment based on a detection result by the sensor.

8. A control method for an image forming apparatus which includes a rotary developing apparatus accommodating a plurality of developer units, each using toner of a different color, in a rotary rack and is configured such that when each of the developer units is located within a predetermined range of rotation, toner stored in a toner storage thereof falls into a developing chamber, thereby supplying toner into the developing chamber, the rotary developing apparatus rotating the rotary in a predetermined rotational direction to bring a targeted one of the developer units to a developing position, the control method comprising:

a toner amount judging step of judging, during execution of a monochrome image forming job which forms an image using toner of a single color, whether or not an amount of toner in a developing chamber of a developer unit for the single color is equal to or less than a predetermined amount, wherein the judging is based on a number of dots formed during the monochrome image forming job;

an execution suspending step of, if the amount of toner is determined to be equal to or less than the predetermined amount, suspending the execution of the monochrome image forming job;

a rotary rack stopping step of rotating the rotary rack and stopping the developer unit within the predetermined range of rotation for a predetermined period of time;

a rotary rack rotating step of, upon elapse of the predetermined period of time, rotating the rotary rack to the developing position; and an execution resuming step of resuming the monochrome image forming job at the developing position.

9. The control method of claim 8 further comprising a toner amount detecting step of detecting an amount of toner remaining in a toner storage of the developer unit for the single color, the toner amount detecting step being prior to the rotary rack stopping step, wherein in the rotary rack stopping step, the developer unit for the single color stops in the predetermined range of rotation for a longer period of time as the amount of toner detected in the toner amount detecting step decreases.

10. The control method of claim 8 further comprising a toner amount detecting step of detecting an amount of toner remaining in a toner storage of the developer unit for the single color, the toner amount detecting step being prior to the rotary rack stopping step, wherein in the rotary rack stopping step, the amount of toner detected in the toner amount detecting step is referred to, and a stop position of the developer unit within the predetermined range of rotation changes as the amount of toner remaining in the toner storage decreases.

11. The control method of claim 8, wherein whether or not the amount of toner is equal to or less than the predetermined amount is determined by calculating an amount of toner consumed during the monochrome image forming job.

12. The control method of claim 8, wherein whether or not the amount of toner is equal to or less than the predetermined amount is determined by counting a number of sheets on which image formation has been performed during the monochrome image forming job.

13. The control method of claim 8, wherein whether or not the amount of toner is equal to or less than the predetermined amount is determined by counting a duration of the monochrome image forming job.

14. The control method of claim 8, wherein whether or not the amount of toner is equal to or less than the predetermined amount is determined by detecting the amount of toner using a detector.

15. A control method for an image forming apparatus which includes a rotary developing apparatus accommodating a plurality of developer units, each using toner of a different color, in a rotary rack and is configured such that when each of the developer units is located within a predetermined range of rotation, toner stored in a toner storage thereof falls into a developing chamber, thereby supplying toner into the developing chamber, the rotary developing apparatus rotating the rotary in a predetermined rotational direction to bring a targeted one of the developer units to a developing position, the control method comprising:

a toner amount judging step of judging, during execution of a monochrome image forming job which forms an image using toner of a single color, whether or not an amount of toner in a developing chamber of a developer unit for the single color is equal to or less than a predetermined amount, wherein the judging is based on a number of dots formed during the monochrome image forming job;

an execution suspending step of, if the amount of toner is determined to be equal to or less than the predetermined amount, suspending the execution of the monochrome image forming job;

a lower-speed rotating step of, while the execution of the monochrome image formation job is suspended, rotating the rotary rack in a manner that the developer unit passes through the predetermined range of rotation at a lower speed than in a range of the rotation other than the predetermined range;

a rotary rack rotating step of rotating the rotary rack to the developing position; and an execution resuming step of resuming the monochrome image forming job at the developing position.

16. The control method of claim 15, wherein whether or not the amount of toner is equal to or less than the predetermined amount is determined by calculating an amount of toner consumed during the monochrome image forming job.

17. The control method of claim 15, wherein whether or not the amount of toner is equal to or less than the predetermined amount is determined by counting a number of sheets on which image formation has been performed during the monochrome image forming job.

18. The control method of claim 15, wherein whether or not the amount of toner is equal to or less than the predetermined amount is determined by counting a duration of the monochrome image forming job.

19. The control method of claim 15, wherein whether or not the amount of toner is equal to or less than the predetermined amount is determined by detecting the amount of toner using a detector.

* * * * *